US006588733B1

(12) United States Patent
Tremeer et al.

(10) Patent No.: US 6,588,733 B1
(45) Date of Patent: Jul. 8, 2003

(54) CONNECTING TOGETHER ELONGATE MEMBERS

(75) Inventors: Michael Anthony Tremeer, Constantia (ZA); Charles Edward Friebus, Constantia (ZA)

(73) Assignee: ECO Beam Technologies Limited, Constantia (ZA)

( * ) Notice: Subject to any disclaimer, the term of this patent is extended or adjusted under 35 U.S.C. 154(b) by 0 days.

(21) Appl. No.: 09/600,246

(22) PCT Filed: Jan. 13, 1999

(86) PCT No.: PCT/AP99/00001

§ 371 (c)(1),
(2), (4) Date: Jan. 31, 2001

(87) PCT Pub. No.: WO99/36647

PCT Pub. Date: Jul. 22, 1999

(30) Foreign Application Priority Data

Jan. 13, 1998 (ZA) ..... 98/0266
Apr. 28, 1998 (ZA) ..... 98/3536

(51) Int. Cl.[7] ..... H01B 17/02

(52) U.S. Cl. ..... 256/19; 256/65.11; 256/59; 256/10

(58) Field of Search ..... 256/19, 59, 65.02, 256/10, 24, 65.11; 403/387

(56) References Cited

U.S. PATENT DOCUMENTS

| | | | | |
|---|---|---|---|---|
| 2,574,711 A | * | 11/1951 | Rose | 256/59 X |
| 2,825,537 A | * | 3/1958 | Wolfe et al. | 256/59 X |
| 2,919,112 A | * | 12/1959 | Cofield | 256/59 X |
| 3,942,763 A | | 3/1976 | Helterbrand et al. | |
| 6,344,617 B1 | * | 2/2002 | Berto | 256/10 X |
| 6,353,187 B1 | * | 3/2002 | Wilson, Jr. | 256/10 X |

FOREIGN PATENT DOCUMENTS

| | | | |
|---|---|---|---|
| DE | 1684647 | * | 12/1969 |
| EP | 0 067 802 A | | 12/1982 |
| FR | 2 264 947 A | | 10/1975 |
| FR | 2 592 512 A | | 7/1987 |
| GB | 1 584 760 A | | 2/1981 |

* cited by examiner

*Primary Examiner*—Lynne H. Browne
*Assistant Examiner*—John Cottingham
(74) *Attorney, Agent, or Firm*—Sterne, Kessler, Goldstein & Fox, P.L.L.C.

(57) ABSTRACT

A method joining two intersecting channel shaped members (12, 14) is disclosed. One of the members (14) has slots (24, 26) therein and the other member (12) has its flanges (18) inserted into the slots (24, 26). The slots (24, 26) can be in the flanges (18) of the member (12) or in the web (16) of the member (12). The members (12, 14) can be the verticals and horizontals of a palisade fence.

6 Claims, 3 Drawing Sheets

CONNECTING TOGETHER ELONGATE MEMBERS

FIELD OF THE INVENTION

THIS INVENTION relates to a method of joining two intersecting strips and to the joint between such strips. The invention also relates to palisade fencing.

BACKGROUND TO THE INVENTION

Palisade fencing comprises spaced fence posts with their lower ends embedded in concrete blocks or compacted earth, two or more horizontal members spanning between adjacent fence posts, and a plurality of vertical members between adjacent fence posts. The horizontal members have their ends bolted or welded to the fence posts and the vertical members are connected to the horizontal members.

Each horizontal member is bolted or welded to each vertical member, this construction requiring all the vertical and horizontal members to be drilled and for a multitude of bolts and nuts to be used. Hence installation is time consuming and expensive, and the end result is not aesthetically pleasing. In addition, the fencing cannot be used as a D.I.Y. product.

The present invention provides a method of joining two intersecting strips which method is particularly, but not exclusively, intended for joining the vertical members of palisade fencing to the horizontal members of the palisade fencing.

BRIEF DESCRIPTION OF THE INVENTION

According to one aspect of the present invention there is provided a method of joining first and second intersecting strips one of which is of channel section and comprises a web, with a flange along each edge of the web, the flanges diverging from one another in the direction away from the web, the method comprising forming two spaced slots in the other of said strips, the slots being at an angle with respect to one another, forcing said flanges of said one member towards one another to decrease the size of the gap between them, inserting the flanges into said slots and releasing the flanges so that they spring apart.

Preferably said other strip is of channel section and comprises a web and a flange along each edge of the web, and said method comprises forming first and second pairs of slots in said flanges of said other strip, the first and second pairs of slots being spaced apart from one another along said other strip and the slots of the first pair being one in each of the flanges of said other strip and the slots of the second pair being one in each of the flanges of said other strip, and inserting the flanges of said one strip into the slots of the other strip.

The method can include the step of deforming at least one of the flanges of said one strip between the flanges of said other strip thereby to prevent said one strip being slid along said other strip.

In the preferred form of the method said other strip is of channel section and comprises a web and a flange along each edge of the web, and said method comprises forming said slots in the web of said other strip. Said web can be of V-shaped in section and comprises two flanks meeting at an apex, said slots being in the flanks and passing through said apex.

According to a further aspect of the present invention there is provided a joint between first and second intersecting strips, the first strip being channel shaped and comprising a web and a flange along each edge of the web, the flanges diverging in the direction away from the web, and said second strip having a pair of slots therein, said slots being at an angle to one another, the flanges of the first strip being in the slots of the second strip.

Preferably said second strip comprises a web and a flange along each edge of the web, said slots being formed in said flanges of said second strip. Said web can be planar or can include a pair of flanks meeting at an apex thereby to provide a raised rib extending in the direction of the length of the second strip.

A sturdy joint is obtained where said second strip comprises a web with a flange along each edge of the web and said web comprises two sloping flanks meeting at an apex, said slots being in said web.

The joint can also include a cover strip fitted to said first strip, the cover strip being in the form of a channel having a web and a flange along each edge of the web, the flanges of the cover strip diverging in the direction away from the web, outside faces of the flanges of the cover strip bearing on inside faces of the flanges of the first strip. In another form the cover strip is in the form of a channel having a web and a flange along each edge of the web, the flanges of the cover strip converging in the direction away from the web, inside faces of the flanges of the cover strip bearing on outside faces of the flanges of the first strip.

According to another aspect of the present invention there is provided palisade fencing comprising a plurality of spaced fence posts with their lower ends embedded in the ground, horizontal members extending between the fence posts, and a plurality of vertical members between each adjacent pair of fence posts, the vertical members and the horizontal members each being channel shaped and comprising a web and a flange along each edge of the web, the flanges of each member diverging in the direction away from the web of that member, one of said members at each place where a vertical member intersects a horizontal member having slots therein, the slots being at an angle to one another, and the flanges of the member which intersects with the slotted member being in the slots of the slotted member.

The webs of the vertical members preferably comprise two sloping flanks meeting at an apex, said slots being formed in the webs of the vertical members. To reduce production costs the vertical members and horizontal members can be of identical profile.

Each fence post is preferably hollow and has in the walling thereof openings the shapes of which match the profiles of said horizontal members, the ends of the horizontal members entering the fence posts through said openings and the parts of the horizontal members within the posts being deformed to prevent their withdrawal from the posts through said openings.

To enable the palisade fencing to be electrified the fence posts have holes therein above the level of the top horizontal members, there being electrically insulating grommets in the holes and wires spanning between the fence posts and passing through said grommets.

In a further form of palisade fencing that can be electrified each fence post comprises a lower part and an upper part, the upper part being mounted on the lower part by means of an electrically insulating connector whereby the upper part is electrically isolated from the lower part, there being upper horizontal members extending between the upper parts of the fence posts and each vertical member of the fencing comprising a lower part attached to a lower horizontal member and an upper part attached to an upper horizontal member, there being a gap between the lower part of each vertical member and the upper part of each vertical member whereby said parts are electrically isolated from one another.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
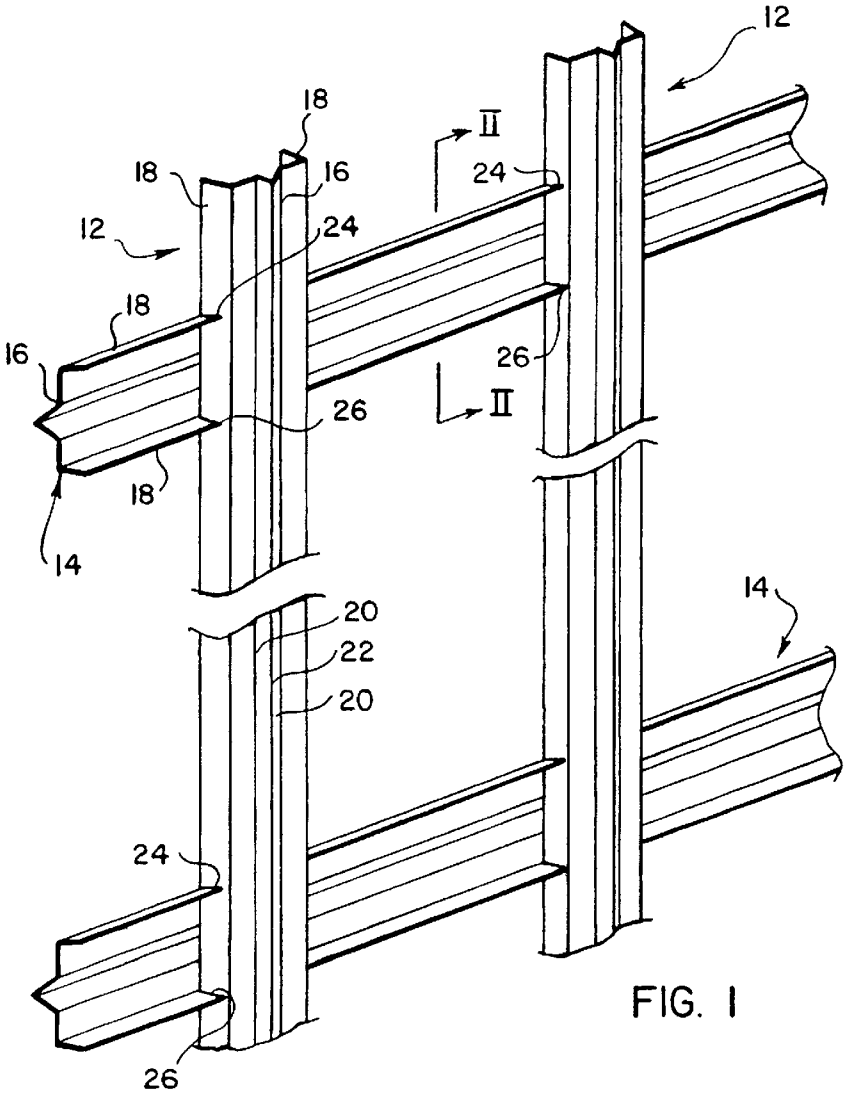
FIG. 1 is a pictorial view of four joints in accordance with the present invention.

The structure shown in FIG. 1 comprises two parallel members 12 and two further parallel members 14 each of which members 14 intersects the two members 12.

Figure 2:
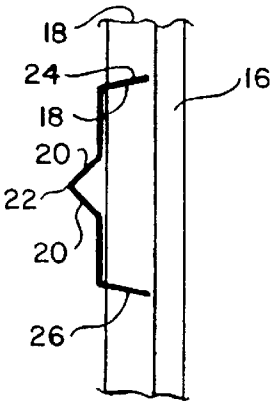
FIG. 2 is a section, to a larger scale, on the line II—II of FIG. 1.

The members 12 are shown as being vertical members and the members 14 are shown as being horizontal members. However, for the purposes of palisade fencing it is preferred that the members 14 be vertical and the members 12 be horizontal. The members 12, 14 are all of the same cross sectional profile and each comprises a web 16 and a flange 18 along each edge of the web 16. The flanges 18 diverge in the direction away from the web 16 as is best seen in FIG. 2.

The members are in the form of elongate strips. Initially the strips are flat and they are profiled by cold rolling. The strips can be of galvanised or coated metal or they can be coated after being rolled. The profile of the members is such that the flanges 18 can be deformed by squeezing them towards one another to reduce the gap between them. The inherent resilience of the metal causes the flanges to spring apart when the deforming force is removed.

Figure 3:
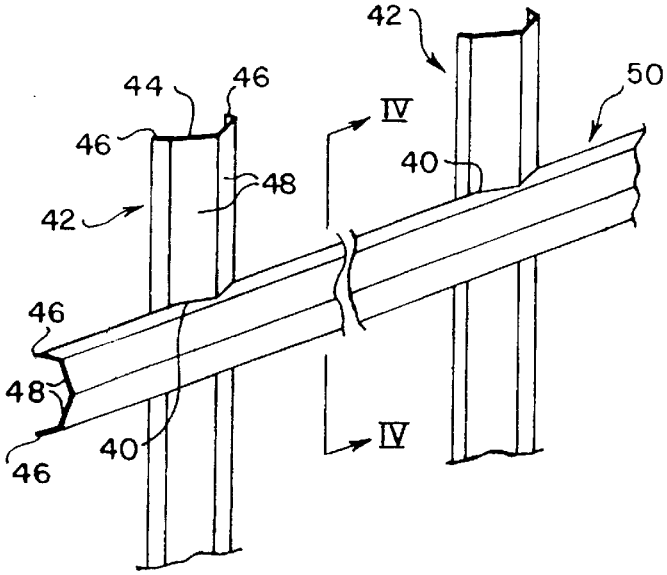
FIG. 3 is a pictorial view of a piece of palisade fencing.
Figure 4:
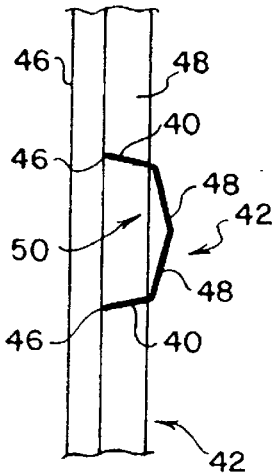
FIG. 4 is a section, to an enlarged scale, on the line IV—IV of FIG. 3.

The webs 16 can be planar. However, for both aesthetic purposes and for resistance to twisting and bending, it is preferred that each web comprise a pair of flanks 20 which intersect at an apex 22 running along the centre line of the member thereby to form a rib. The rib can be the full width of the strip between the flanges 18 as shown in FIGS. 3 and 4 or narrower than the strip as shown in FIG. 1 and 2.

The flanges 18 of the members 12 are slotted. In FIG. 1 there is, at each intersection, an upper slot 24 in each flange 18 and a lower slot 26 in each flange 18. The upper slots 24 are aligned with one another and the lower slots 26 are aligned with one another. The slots 24 form a first pair of slots and the slots 26 form a second pair of slots, the pairs of slots being spaced apart along the members 12.

The distance between the slots 24 and 26 in the same flange 18 measured along the free edge of the flange is less than the distance between these slots measured in a straight line between their closed ends. Thus the slots diverge in the direction away from the free edges of the flanges. This is also best seen in FIG. 2 and it will be noted that the flanges 18 and the slots 24, 26 are of the same configuration. The spacing between the free edges of the flanges 18 of the members 14 is greater than the spacing between the slots measured at the entrances to the slots.

To secure a member 12 to a member 14 where they intersect, the flanges of the member 14 are squeezed towards one another. This can be achieved by means of a hand operated tool comprising two sets of spaced jaws which close onto the flanges 18 at spaced locations. It is the deformed parts of the flanges 18 between the jaws that are presented to the slots 24, 26 and pushed into the slots. When the jaws are opened the flanges spring apart thus interlocking the vertical and horizontal members.

Between the flanges 18 of the members 12, the flanges 18 of the members 14 are bent to prevent the members 12 being slid along the members 14. This can be achieved by simply bending the flanges 18 to one side or they can be kinked by a tool which bends a part of the flange upwards and an adjacent part downwards to an S-formation.

Figure 2A:
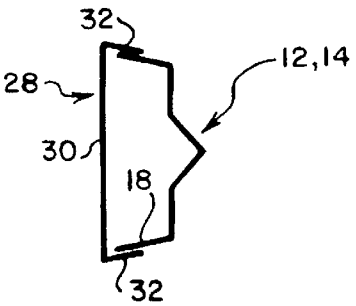
FIGS. 2*a* and 2*b* are sections illustrating two forms of cover strip.

To provide the members 12 and 14 with a box-like appearance instead of a channel appearance, cover strips can be used. In FIG. 2*a* a cover strip 28 is shown, this having a web 30 and a pair of flanges 32 which converge with one another in the direction away from the web 30. The inside faces of the flanges 32 bear on the outside faces of the flanges 18. The cover strips 28 can be forced onto the members 12 and/or 14 using, for example, a rubber mallet. Alternatively the cover strips can be slid on from the ends of the members 12 and 14 as erection of the fencing proceeds.

Figure 2B:
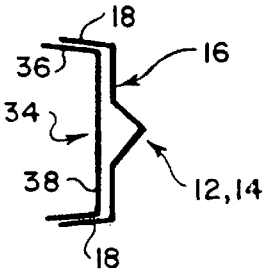

In the form of FIG. 2*b* the cover strip is designated 34. The outside faces of the flanges 36 of the cover strip 34 bear on the inside faces of the flanges 18 of the members 12 and 14. The web 38 of the cover strip 34 lies against, or close to, the web 16 of the respective member 12 or 14. It will be understood that this cover strip 34 does not provide a box-like appearance but simply conceals the inside of the respective member 12, 14.

The construction shown in FIGS. 3 and 4 differs from the construction of FIGS. 1 and 2 in that the slots, designated 40, of the vertical members 42 are formed in the webs 44 of the vertical members and not in their flanges 46. Each web 44 is of vee-shape, the flanks 48 which meet at an apex extending from the flanges 46 to the apex. This can be contrasted to the configuration of FIG. 1 where the web has planar portions on each side of the flanks 20. The horizontal member 50 in FIGS. 3 and 4 is of the same configuration as the vertical members 42. In this form it is the flanges 46 of the horizontal members 50 which are bent to stop the vertical members being moved horizontally. The horizontal members 50 cannot, of course, be moved horizontally because of their connections to the fence posts, as will be described hereinafter. The vertical members 42 cannot be moved vertically because of the parts of the flanges 46 of the horizontal member 50 which are in the slots 40.

Figure 5:
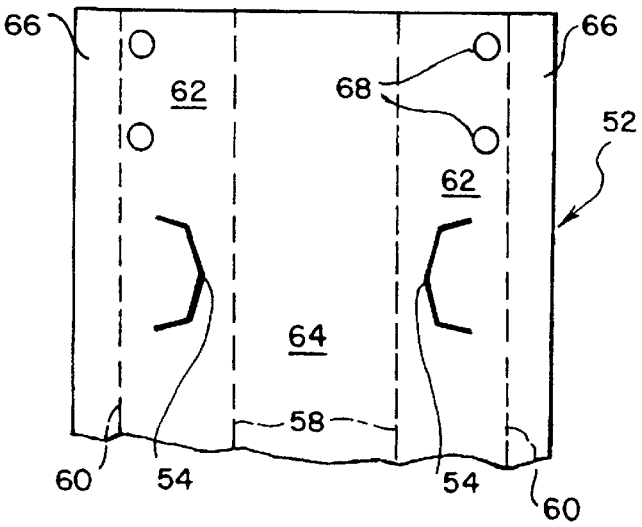
FIG. 5 is a plan view of part of a metal strip.

The metal strip 52 shown in FIG. 5 is of planar form and only a short part of its length is illustrated. Two openings 54 are punched in the strip, these being of the same profile as the horizontal member 50 shown in FIGS. 3 and 4. The strip 52 is formed into the fence post 56 shown in FIG. 6 by bending it along the dotted lines 58 and 60 shown in FIG. 5. The openings 54 are now in opposed side walls 62 of the post. The front of the post is closed by a front wall 64 and the rear of the post is open between two flanges 66. This permits access to be had to the ends of the horizontal members 50 inserted into the post through the slots 54 so that they can be deformed and thus prevented from being withdrawn from the posts 56.

Figure 6:
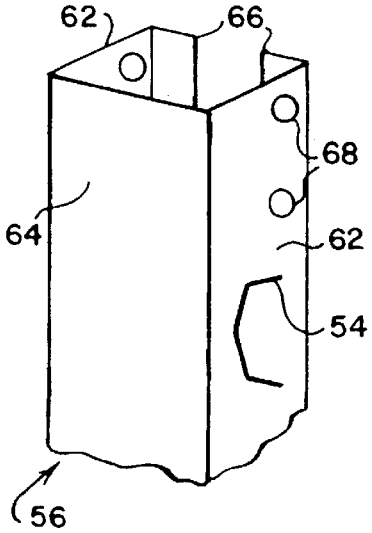
FIG. 6 is a pictorial view showing the strip of FIG. 5 bent to form a fence post.
Figure 7:
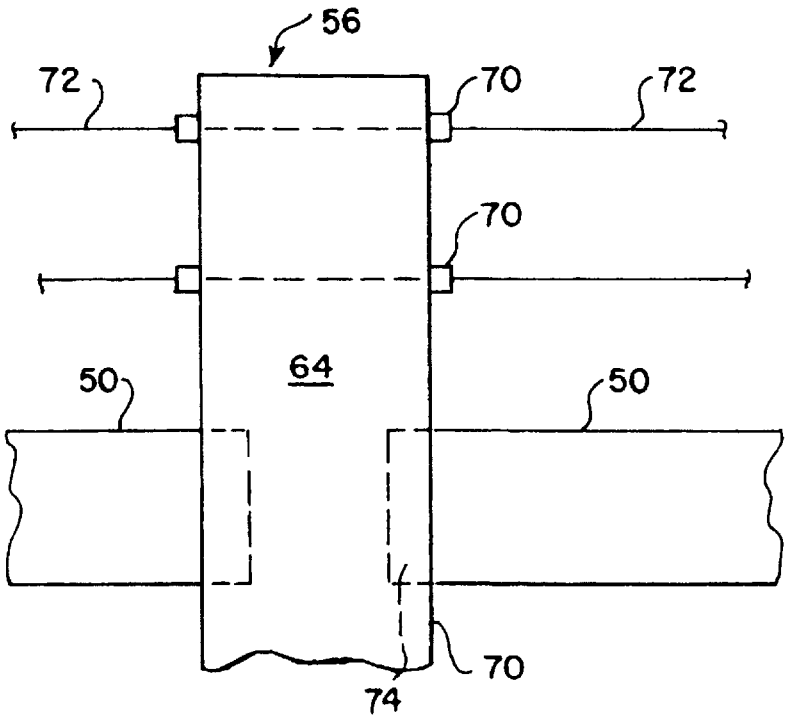
FIG. 7 is an elevation illustrating the fence post of FIG. 6 and also illustrating electrification wires.

The strip 52 is punch ed with two holes 68 in what become the side walls 62 thereof. The holes 68 are above the openings 54 and close to the flanges 66. Grommets 70 (FIG. 7) of electrically insulating material are forced into the holes 68, and wires 72 to which a high voltage is applied pass through the grommets 70. The upper horizontal members 50 of the fencing are illustrated in FIG. 6 and it will be noted that they are just below the lowermost of the two wires 72. The end portions 74 of the horizontal members 50 are within the post 56.

Figure 8:
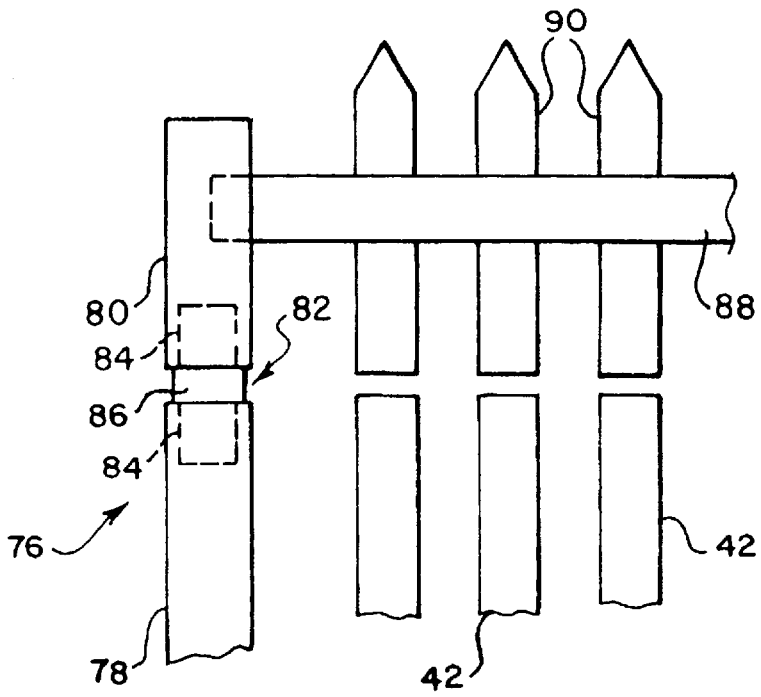
FIG. 8 is an elevation of another form of electrified palisade fencing.

In FIG. 8 the fence post 76 is in two parts, the longer, lower part being designated 78 and the shorter upper part being designated 80. A connector 82 of synthetic plastics material, or other electrically insulating material, has a spigot 84 at each end and a central section 86 between the spigots. The spigots fit into the upper and lower parts 78, 80 of the fence post 76 and the section 86, which is of greater transverse dimensions than the spigots, prevents the upper and lower parts touching.

A horizontal member 88 extends from the part 80.

Each vertical member 42 terminates at about the level of the connector 82. Short upper vertical members 90 are secured to the horizontal member 88, there being gaps between the members 42 and 90. The entire upper part of the fence including the members 90, the member 88 and the upper part 80 can be connected to a source of high voltage.

What is claimed is:

1. A joint between first and second intersecting strips comprising:

a first strip being channel shaped and comprising a web and a flange along each edge of the web, the flanges diverging in the direction away from the web;

a second strip having a pair of slots therein, the slots being at an angle to one another, the flanges of said first strip being in the slots of said second strip; and a cover strip fitted to said first strip, said cover strip being in the form of a channel having a web and a flange along each edge of the web, the flanges of said cover strip diverging in the direction away from the web, and wherein outside faces of the flanges of said cover strip bear on inside faces of the flanges of said first strip.

2. A method of joining first and second intersecting strips, one of said strips of which is of channel section and comprises a web with a flange along each edge of the web, the flanges diverging from one another in the direction away from the web and the other of said strips of which is of channel section and comprises a web of V-shape in section defined by two flanks meeting at an apex and a flange along each edge of said web, the method comprising:

forming two spaced slots in said flanks of said web of the other of said strips, the slots being at an angle with respect to one another and passing through said apex;

forcing said flanges of said one strip towards one another to decrease the size of the gap between them;

inserting the flanges into said slots; and releasing the flanges so that they spring apart.

3. A joint between first and second intersecting strips comprising:

a first strip being channel shaped and comprising a web and a flange along each edge of the web, the flanges diverging in the direction away from the web;

a second strip having a pair of slots therein, said slots being at an angle to one another, the flanges of the first strip being in the slots of the second strip; and a cover strip fitted to said first strip, said cover strip being in the form of a channel having a web and a flange along each edge of the web, the flanges of said cover strip converging in the direction away from the web, and wherein inside faces of the flanges of said cover strip bear on outside faces of the flanges of said first strip.

4. Palisade fencing comprising:

a plurality of spaced fence posts with lower ends thereof embedded in the ground;

horizontal members extending between the fence posts; and a plurality of vertical members between each adjacent pair of fence posts, said vertical members and said horizontal members each being channel shaped and comprising a web and a flange along each edge of the web, the flanges diverging in the direction away from the web and the webs of said vertical members comprising two sloping flanks meeting at an apex, said vertical members at each place where a vertical member intersects a horizontal member having slots in the webs thereof, the slots passing through the apices and being at an angle to one another, the flanges of said horizontal members where they intersect with said vertical members being in the slots of said vertical members.

5. The palisade fencing as claimed in claim 4, wherein said fence posts have holes therein above the level of said top horizontal members, there being electrically insulating grommets in the holes and wires spanning between said fence posts and passing through the grommets.

6. The palisade fencing as claimed in claim 4, wherein each fence post comprises a lower part and an upper part, the upper part being mounted on the lower part by means of an electrically insulating connector whereby the upper part is electrically isolated from the lower part, there being upper horizontal members extending between the upper parts of said fence posts, and each vertical member of the palisade fencing comprising a lower part attached to a lower horizontal member and an upper part attached to an upper horizontal member, there being a gap between the lower part of each vertical member and the upper part of each vertical member whereby the upper and lower parts of said vertical members are electrically isolated from one another.

* * * * *